US011020638B2

(12) United States Patent
Takahashi et al.

(10) Patent No.: US 11,020,638 B2
(45) Date of Patent: Jun. 1, 2021

(54) IRON-TYPE GOLF CLUB HEAD

(71) Applicant: BRIDGESTONE SPORTS CO.,LTD., Tokyo (JP)

(72) Inventors: Hiroshi Takahashi, Tokyo (JP); Takaharu Takechi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 16/800,101

(22) Filed: Feb. 25, 2020

(65) Prior Publication Data

US 2020/0338399 A1 Oct. 29, 2020

(30) Foreign Application Priority Data

Apr. 26, 2019 (JP) ..... JP2019-086367

(51) Int. Cl.
*A63B 53/04* (2015.01)

(52) U.S. Cl.
CPC ..... *A63B 53/047* (2013.01); *A63B 53/0412* (2020.08); *A63B 53/0433* (2020.08); *A63B 53/0458* (2020.08); *A63B 2209/00* (2013.01)

(58) Field of Classification Search
CPC ..... A63B 2209/00; A63B 53/047; A63B 53/0412; A63B 53/0433; A63B 53/0458
See application file for complete search history.

(56) References Cited

U.S. PATENT DOCUMENTS 5,184,823 A * 2/1993 Desboilles ..... A63B 53/047 473/345
5,282,624 A * 2/1994 Viste ..... A63B 60/00 473/342
5,601,501 A 2/1997 Kobayashi
5,735,755 A * 4/1998 Kobayashi ..... A63B 53/04 473/342
5,766,092 A * 6/1998 Mimeur ..... A63B 60/00 473/329
6,093,116 A 7/2000 Hettinger et al.
6,200,228 B1 * 3/2001 Takeda ..... A63B 60/00 473/324
6,984,180 B2 * 1/2006 Hasebe ..... A63B 53/0475 473/291
7,018,303 B2 * 3/2006 Yamamoto ..... A63B 60/00 473/329
8,235,842 B2 8/2012 Cole et al.
8,475,293 B2 * 7/2013 Morin ..... A63B 53/047 473/329
8,616,998 B2 * 12/2013 Cole ..... A63B 60/00 473/329

(Continued)

FOREIGN PATENT DOCUMENTS

JP H9-038252 2/1997
JP H09-117538 5/1997

(Continued)

*Primary Examiner* — Stephen L Blau
(74) *Attorney, Agent, or Firm* — IPUSA, PLLC

(57) ABSTRACT

An iron-type golf club head for a golf club includes a body and a face joined to the body. The face includes a front surface including a ball striking surface, and a rear surface facing an interior surface of the body. Multiple independent depressions are formed in the rear surface toward the front surface. Each of the independent depressions is at least partially filled with a non-metallic material.

13 Claims, 7 Drawing Sheets

(56) References Cited

U.S. PATENT DOCUMENTS

| | | | | |
|---|---|---|---|---|
| 9,808,685 | B1 * | 11/2017 | Westrum | A63B 53/047 |
| 10,039,965 | B1 * | 8/2018 | Seluga | A63B 60/00 |
| 10,173,109 | B1 * | 1/2019 | Seluga | A63B 60/00 |
| 10,596,425 | B2 * | 3/2020 | Parsons | A63B 60/02 |
| 2014/0248977 | A1 * | 9/2014 | Morin | A63B 53/047<br>473/342 |
| 2020/0353325 | A1 * | 11/2020 | Taylor | A63B 53/0475 |

FOREIGN PATENT DOCUMENTS

| | | |
|---|---|---|
| JP | 2000-225217 | 8/2000 |
| JP | 2005-137634 | 6/2005 |

* cited by examiner

IRON-TYPE GOLF CLUB HEAD

CROSS-REFERENCE TO RELATED APPLICATION

This application is based on and claims priority to Japanese patent application No. 2019-086367, filed on Apr. 26, 2019, the entire contents of which are incorporated herein by reference.

BACKGROUND OF THE INVENTION

1. Field of the Invention

The invention relates to iron-type golf club heads.

2. Description of the Related Art

When hitting a golf ball with an iron-type golf club head, the flight distance of the golf ball differs depending on whether the golf ball is hit by the sweet area or an area other than the sweet area (off the center) of the face of the iron-type golf club head. This causes the flight distance to be unstable, so that sufficient ball striking performance may not be achieved. Therefore, techniques for improving ball striking performance, such as those described in Japanese Patent No. 2929587, Japanese Laid-open Patent Publication No. 2000-225217, Japanese Patent No. 3006463, Japanese Laid-open Patent Publication No. 2005-137634, and U.S. Pat. No. 8,235,842, have been discussed.

SUMMARY OF THE INVENTION

According to an aspect of the invention, an iron-type golf club head includes a body and a face joined to the body. The face includes a front surface including a ball striking surface, and a rear surface facing an interior surface of the body. Multiple independent depressions are formed in the rear surface toward the front surface. Each of the independent depressions is at least partially filled with a non-metallic material.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF EMBODIMENT

Figure 1:
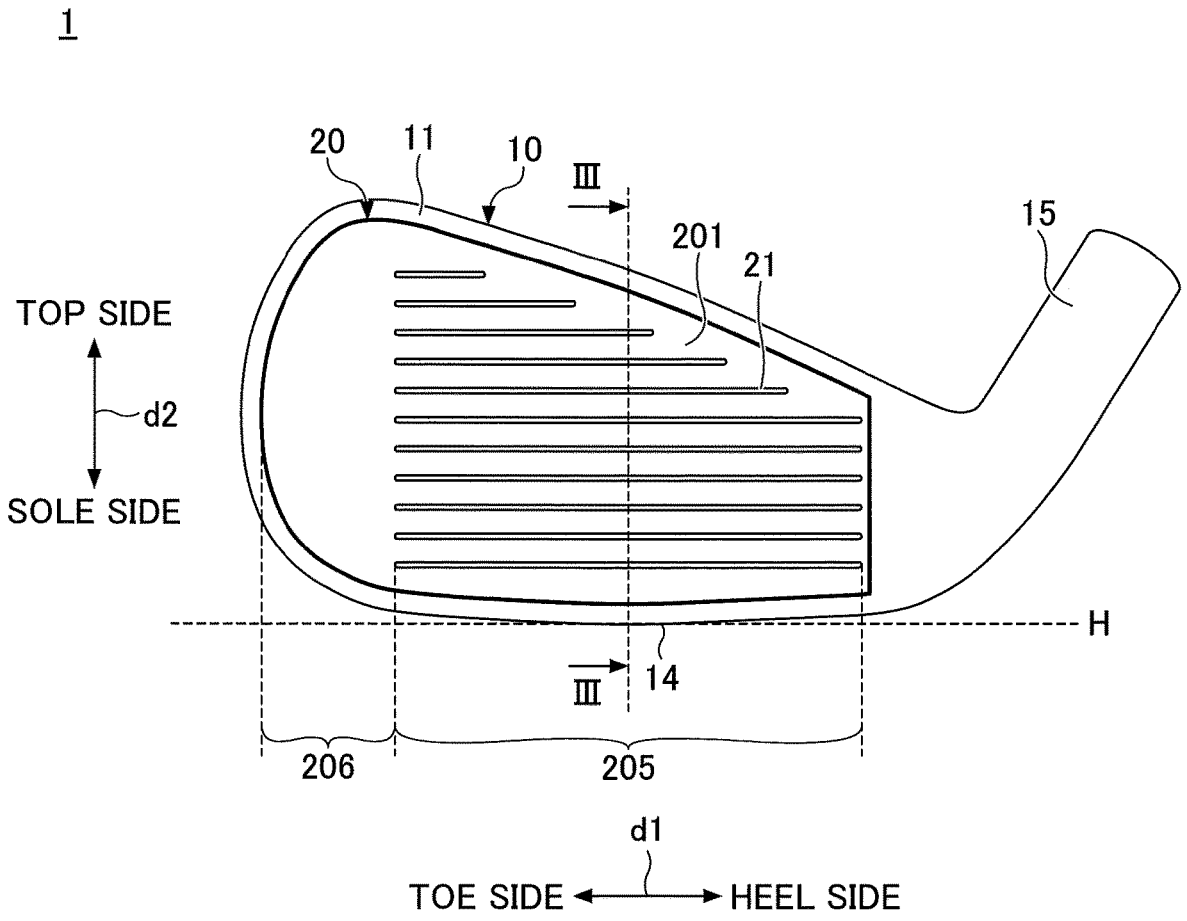
FIG. 1 is a front elevational view of an iron-type golf club head according to an embodiment.

According to an aspect of the invention, an iron-type golf club head that can achieve a stable flight distance is provided.

One or more embodiments of the invention are described below with reference to the accompanying drawings. In the following, the same elements or components are referred to using the same reference numeral, and duplicate description thereof may be omitted.

Figure 2:
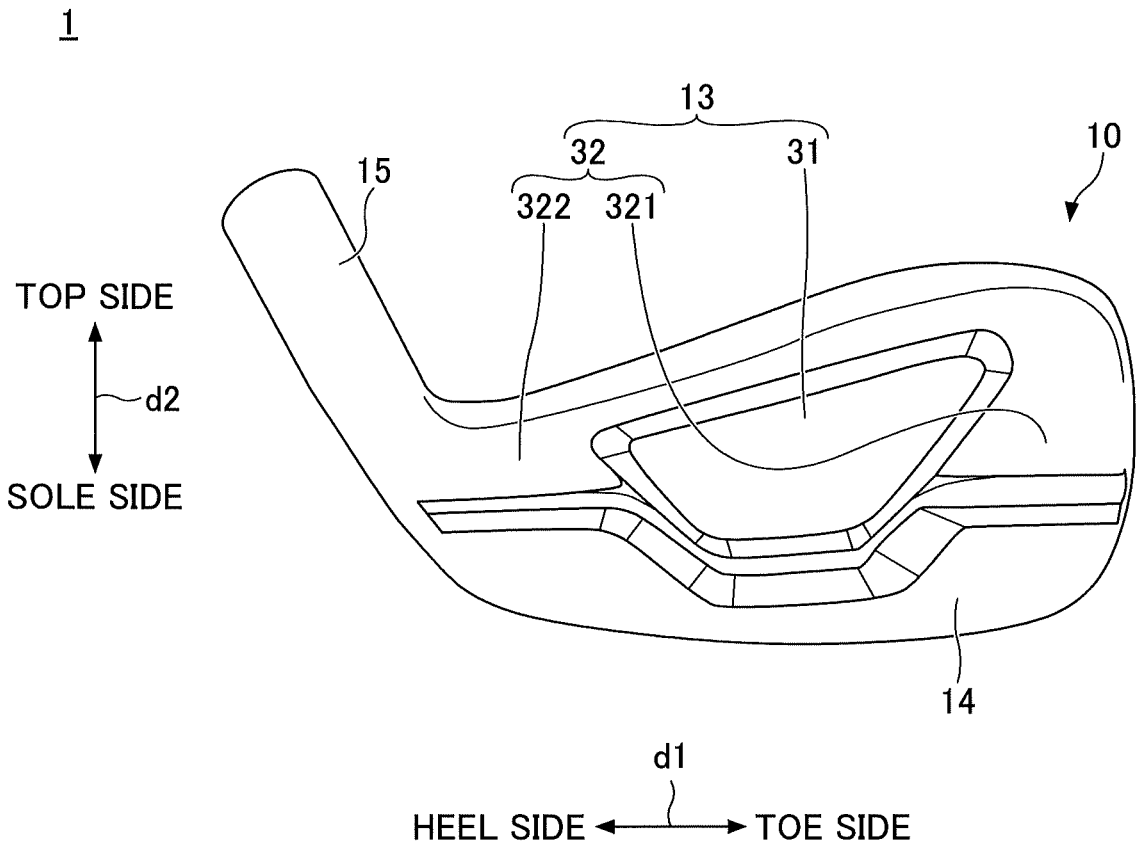
FIG. 2 is a rear elevational view of the iron-type golf club head according to the embodiment.
Figure 3:
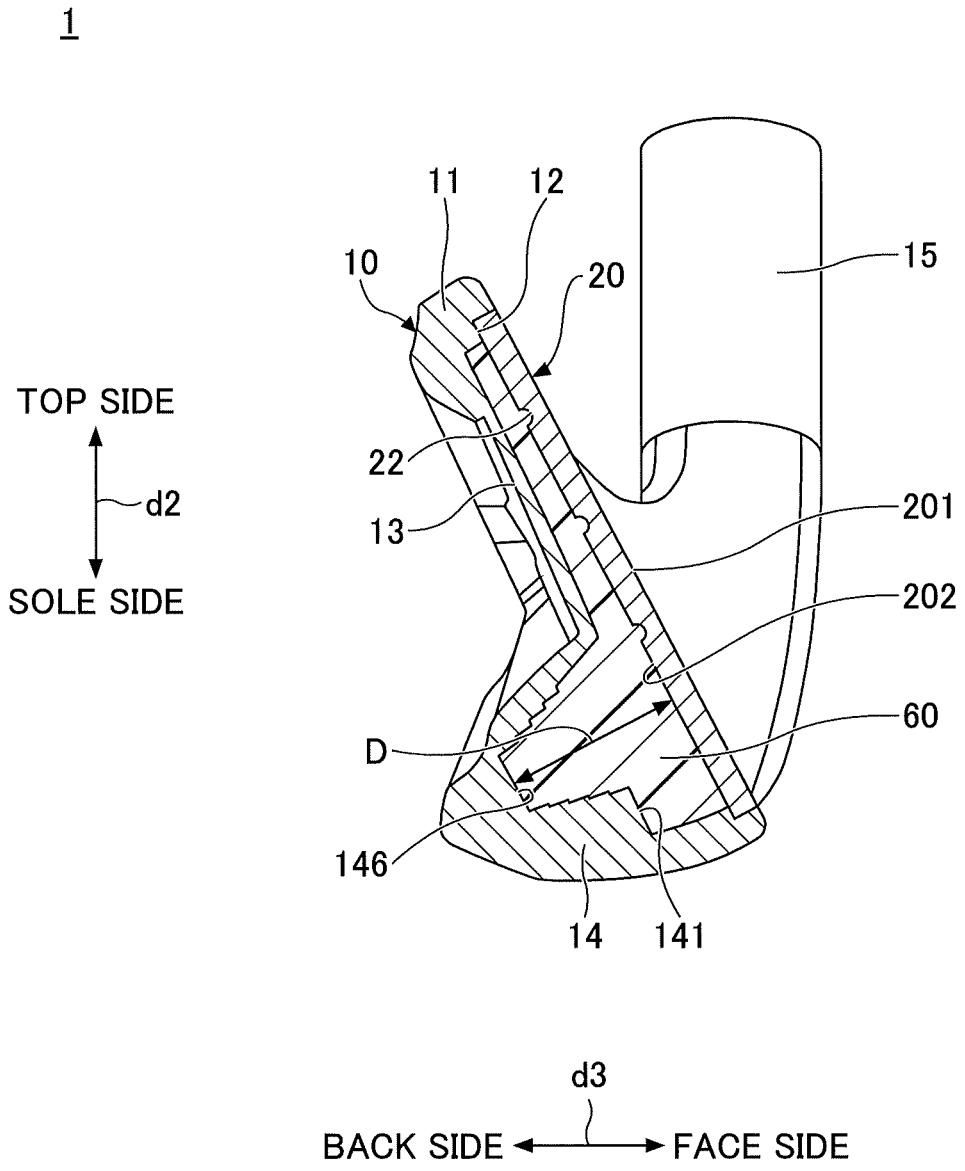
FIG. 3 is a sectional view of the iron-type golf club head according to the embodiment.

FIGS. 1 and 2 are a front elevational view and a rear elevational view, respectively, of an iron-type golf club head 1 (hereinafter, "iron head 1") according to an embodiment. FIG. 3 is a sectional view of the iron head 1, illustrating a section taken along a plane indicated by the line III-III of FIG. 1, which extends in the face-back direction and passes through the substantial center of a face 20 of the iron head 1.

The front elevational view of FIG. 1 is a view looking at the iron head 1 on its front surface side, depicting the iron head 1 resting (soled) on a horizontal plane H (corresponding to a ground surface) at a standard lie angle and a standard loft angle. In FIGS. 1 through 3, the double-headed arrow d1 indicates the "toe-heel" (left-right) direction, namely, the direction from the toe side to the heel side or the direction from the heel side to the toe side, of the iron head 1, the double-headed arrow d2 indicates the "top-sole" (up-down) direction, namely, the direction from the top side to the sole side or the direction from the sole side to the top side, of the iron head 1, and the double-headed arrow d3 indicates the "face-back" (front-rear) direction, namely, the direction from the face side to the back side or the direction from the back side to the face side, of the iron head 1.

The iron head 1 depicted in FIGS. 1 through 3 is a head for an iron-type golf club, and is a structure including a body 10 and the face 20. The face 20 is joined to the body 10 by, for example, welding. In each constituent part of the structure, a face-side surface may be referred to as "front surface" and a back-side surface may be referred to as "rear surface."

Figure 4:
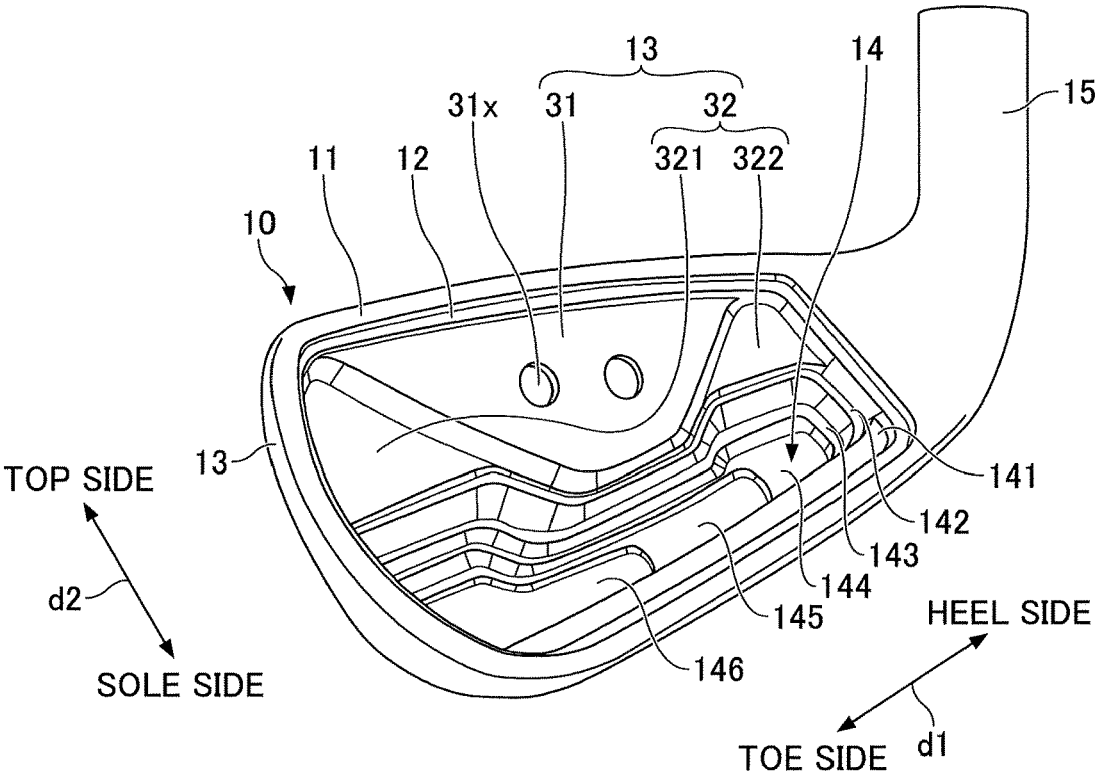
FIG. 4 is a front-side perspective view of a body according to the embodiment.
Figure 5:
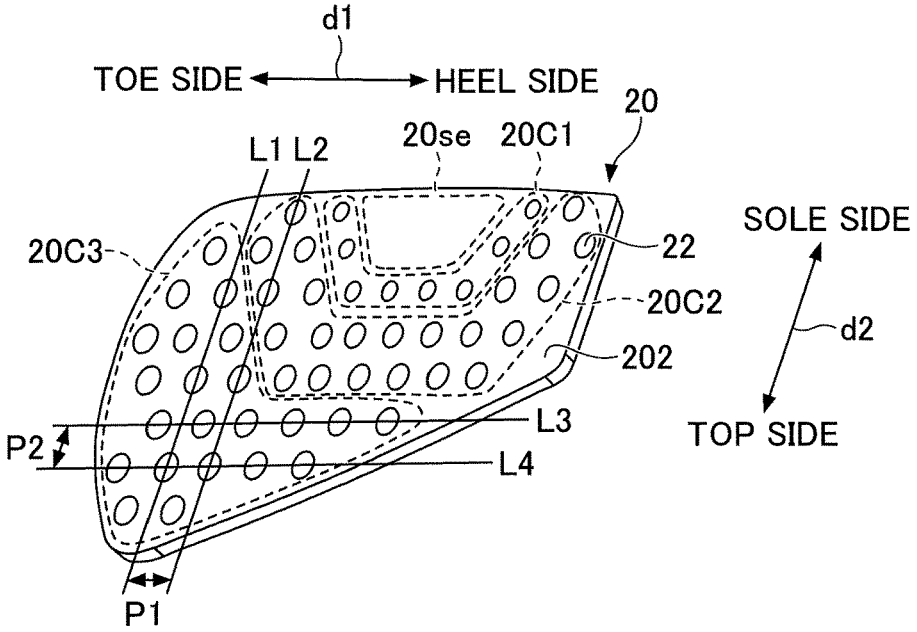
FIG. 5 is a rear-side perspective view of a face according to the embodiment.

FIG. 4 is a front-side perspective view of the body 10 according to the embodiment. FIG. 5 is a rear-side perspective view of the face 20 according to the embodiment.

Referring to FIGS. 4 and 5 as well as FIGS. 1 through 3, the body 10 includes a frame 11, a face placement part 12, a back 13, a rear protrusion 14, and a hosel 15.

The body 10 may be formed using, for example, a metal material such as a titanium alloy, titanium, stainless steel, an aluminum alloy, or carbon steel. The process for manufacturing the body 10 may be, but is not limited to, forging, casting, machining, or any combination thereof.

The face 20 includes a face (front) surface 201 and a rear surface 202 that face in opposite directions. The face surface 201 includes a ball striking surface. The face 20 has a predetermined thickness. The face surface 201 defines an exterior surface of the face 20. The thickness of the face 20 is, for example, 0.5 mm or more and 3 mm or less, and preferably, 1.2 mm or more and 2.1 mm or less.

Multiple score lines 21 (grooves formed in the face surface 201 toward the rear surface 202) elongated in the toe-heel direction are arranged at predetermined intervals in the top-sole direction in the face surface 201.

The face 20 includes a striking part 205 designed to strike a golf ball and a toe part 206 formed on the toe side of the striking part 205. The toe part 206 is not designed to strike a golf ball. In the face 20, the striking part 205 is a region where the score lines 21 are formed in the face surface 201. The toe part 206 continues (extends) from the striking part 205 on its toe side.

The face 20 may be formed using, for example, a metal material such as a titanium alloy, titanium, stainless steel, an aluminum alloy, or carbon steel. The process for manufacturing the face 20 may be, but is not limited to, forging, casting, machining, or any combination thereof.

In the body 10, the face placement part 12 that positions the face 20 is formed inside the frame 11 having a frame shape. The front surface (face-side surface) of the face placement part 12 is at a position set back toward the back 13 from the front surface (face-side surface) of the frame 11. The front surface of the face placement part 12 contacts the outer edge (peripheral) portion of the rear surface 202 of the face 20. The amount of setback (the size of depression) of the front surface of the face placement part 12 from the front surface of the frame 11 is approximately equal to the thickness of the face 20.

The back 13 includes a flat part 31 and a protruding part 32. The flat part 31 is positioned around the center of the back 13 in the toe-heel direction, and has a substantially inversed triangular shape.

Two openings 31*x* are provided in the flat part 31 to pierce through the flat part 31. Each opening 31*x* may be closed with, for example, a non-metallic material 60. Alternatively, a metal plate such as a nameplate may be so placed on the exterior side of the flat part 31 as to conceal the openings 31*x*.

The shape of the openings 31*x* is, for example, circular. Three or more openings 31*x* may be provided in the flat part 31. The technical significance of providing the flat part 31 with the multiple openings 31*x* is described below.

The protruding part 32 includes a substantially triangular toe-side protrusion 321 and a substantially triangular heel-side protrusion 322. The toe-side protrusion 321 is formed on the toe side of the flat part 31 to protrude outward of the iron head 1 relative to the flat part 31. The heel-side protrusion 322 is formed on the heel side of the flat part 31 to protrude outward of the iron head 1 relative to the flat part 31.

When viewed from the inside of the body 10, the interior surface of the flat part 31 is depressed to the back side relative to the face placement part 12 and the interior surfaces of the toe-side protrusion 321 and the heel-side protrusion 322 are further depressed to the back side relative to the interior surface of the flat part 31, within the face placement part 12.

The rear protrusion 14 lies (extends) in the toe-heel direction on the sole side of the back 13 below the center of the iron head 1, and protrudes rearward of the iron head 1 relative to the back 13. The rear protrusion 14 forms part of the sole. A surface of the rear protrusion 14 that faces the horizontal plane H when the iron head 1 is soled on the horizontal plane H at a standard lie angle and a standard loft angle forms the sole along with the vicinity of the surface. Here, being below the center of the iron head 1 means being on the sole side of a position whose height is half the maximum height of the face 20.

The interior surface (facing the rear surface 202 of the face 20) of the rear protrusion 14 includes a stepped portion. The stepped portion is stepped to form wall faces 141, 142, 143, 144, 145 and 146 that are arranged substantially parallel to the rear surface 202 of the face 20. When viewed in a direction normal to the face surface 201, the wall faces 141 through 146 are at positions that gradually increase in depth from the rear surface 202 as the positions increase in distance inward from the outer edge of the rear protrusion 14. Here, being substantially parallel means that the angle formed by two surfaces (planes) is within ±5 degrees (the same applies hereinafter).

When viewed in a direction normal to the face surface 201, the wall face 141 extends in the toe-heel direction at the position closest to the sole in the interior surface of the rear protrusion 14. The wall face 141 is an elongated portion positioned approximately as deep as the interior surfaces of the toe-side protrusion 321 and the heel-side protrusion 322. The wall face 141 faces the rear surface 202 of the face 20.

When viewed in a direction normal to the face surface 201, the wall face 142 is a frame-shaped portion depressed to the back side relative to the wall face 141. The wall face 142 faces the rear surface 202 of the face 20.

When viewed in a direction normal to the face surface 201, the wall face 143 is positioned inside the wall face 142. The wall face 143 is a frame-shaped portion depressed to the back side relative to the wall face 142. The wall face 143 faces the rear surface 202 of the face 20.

When viewed in a direction normal to the face surface 201, the wall face 144 is positioned inside the wall face 143. The wall face 144 includes a frame-shaped portion forming part of the outer edge of the wall face 144 and a flat portion continuing (extending) from the frame-shaped portion and positioned on the heel side in the interior surface of the rear protrusion 14. The frame-shaped portion and the flat portion of the wall face 144 face the rear surface 202 of the face 20.

When viewed in a direction normal to the face surface 201, the wall face 145 is positioned inside the wall face 144. The wall face 145 includes a frame-shaped portion forming part of the outer edge of the wall face 145 and a flat portion continuing (extending) from the frame-shaped portion and positioned around the center of the interior surface of the rear protrusion 14 in the toe-heel direction. The frame-shaped portion and the flat portion of the wall face 145 face the rear surface 202 of the face 20.

When viewed in a direction normal to the face surface 201, the wall face 146 is positioned inside the wall face 145. The wall face 146 is a flat portion positioned on the toe side in the interior surface of the rear protrusion 14. The wall face 146 faces the rear surface 202 of the face 20. The wall face 146 is the deepest portion (bottommost interior surface) of the rear protrusion 14. A depth (distance) D from the rear surface 202 of the face 20 to the wall face 146 in a direction perpendicular to the rear surface 202 is, for example, 5 mm or more and 15 mm or less, and preferably, 10 mm or more and 15 mm or less.

Referring to FIG. 5, the face 20 includes multiple independent depressions 22 formed in the rear surface 202 toward the face surface 201. Here, being "independent" means, for example, that multiple grooves do not contact or cross each other, namely, that the depressions 22 are out of contact with each other.

The depressions 22 may be placed, for example, in a staggered arrangement, but may also be placed in a matrix, at random, or at any positions as required, for example.

The shape of the depressions 22 as viewed in a direction normal to the rear surface 202 may be, but is not limited to, for example, a circular shape, and may also be elliptical or polygonal to the extent that the depressions 22 are independent of each other. The depressions 22 may have a more complicated shape such as a star shape. The depressions 22, however, are preferably circular in terms of the accuracy of formation of the depressions 22.

According to this embodiment, a description is hereinafter given of an example where the shape of the depressions 22 as viewed in a direction normal to the rear surface 202 is circular. The cross-sectional shape of the depressions 22 is, for example, a curved shape deepest at its center. The cross-sectional shape of the depressions 22 may be either spherical or aspherical.

The depressions 22 are not placed in a sweet area 20*se* of the face 20, and are placed in substantially the entirety of the rear surface 202 of the face 20 around the sweet area 20*se*. Here, letting the initial velocity of a golf ball ("ball initial velocity") at which the iron head 1 can gain a maximum flight distance be 100, the sweet area refers to the aggregate area of striking points at which the maximum flight distance can be gained and their surrounding striking points at which a ball initial velocity of 98 or more can be gained.

According to the illustration of FIG. 5, the face 20 includes an area 20C1, an area 20C2, and 20C3 that are successively arranged in order in a direction away from the sweet area 20*se* and are provided with small circular depressions, medium circular depressions, and large depressions, respectively, as the depressions 22. The medium circular depressions are deeper than the small circular depressions. The large depressions are deeper than the medium circular depressions. The depressions 22 placed in the rear surface 202, however, are not limited in diameter to these three types.

The diameter of the small circular depressions is, for example, 2.00 mm or more and less than 2.75 mm. Where the small circular depressions are deepest, the depth of the small circular depressions is, for example, 0.200 mm or more and less than 0.275 mm. The diameter of the medium circular depressions is, for example, 2.75 mm or more and less than 3.50 mm. Where the medium circular depressions are deepest, the depth of the medium circular depressions is, for example, 0.275 mm or more and less than 0.350 mm. The diameter of the large circular depressions is, for example, 3.50 mm or more and 4.25 mm or less. Where the large circular depressions are deepest, the depth of the large circular depressions is, for example, 0.350 mm or more and 0.425 mm or less.

Referring to FIG. 5, two lines L1 and L2 are drawn parallel to the top-sole direction. The depressions 22 include, for example, a depression 22 whose center is positioned on the line L1 or L2. In the toe-heel direction, respective pitches P1 of the small circular depressions, the medium circular depressions, and the large circular depressions are, for example, 5.5 mm or more and 8.0 mm or less. In the toe-heel direction, for example, the pitch of the medium circular depressions may be greater than the pitch of the small circular depressions, and the pitch of the larger circular depressions may be greater than the pitch of the medium circular depressions.

Referring to FIG. 5, two lines L3 and L4 are drawn parallel to the toe-heel direction. The depressions 22 include, for example, a depression 22 whose center is positioned on the line L3 or L4. In the top-sole direction, respective pitches P2 of the small circular depressions, the medium circular depressions, and the large circular depressions are, for example, 5.5 mm or more and 6.0 mm or less. In the top-sole direction, the respective pitches of the small circular depressions, the medium circular depressions, and the large circular depressions may be the same, for example.

By thus adjusting the diameter and the pitch of the depressions 22, it is possible to distribute stress and ensure strength when the face 20 strikes a golf ball.

The body 10 and the face 20 are joined by, for example, welding with a space formed between the interior surface of the body 10 and the rear surface 202 of the face 20. The space is filled with the non-metallic material 60.

More specifically, by joining the face 20 to the face placement part 12 of the body 10, a space is formed between the respective interior surfaces of the flat part 31, the protruding part 32, and the rear protrusion 14 of the body 10 and the rear surface 202 of the face 20, and the space is filled with the non-metallic material 60. The non-metallic material 60 is poured into the space from one of the openings 31*x* by, for example, injection, and is cured. The other opening 31*x* serves as an air vent hole.

Thus, a space is formed between the interior surface of the body 10 and the rear surface 202 of the face 20. As a result, it is possible to reduce the loss of flight distance when a golf ball is struck by an area other than the sweet area 20*se*. Furthermore, by filling the space with the non-metallic material 60, the non-metallic material 60 is behind the face 20. Therefore, impact feel can be improved.

Furthermore, as described above, the toe part 206 is formed on the toe side of the striking part 205 in the face 20, and a space is formed between the interior surface of the body 10 and the rear surface of the striking part 205 and between the interior surface of the body 10 and the rear surface of the toe part 206. This makes it possible to increase the volume of the space. Therefore, the effects of reduction in the loss of flight distance and improvement in impact feel are further increased. The volume of the space is, for example, 5 $cm^3$ or more and 22 $cm^3$ or less, and preferably, 16 $cm^3$ or more and 20 $cm^3$ or less.

Each of the depressions 22 provided in the rear surface 202 of the face 20 is filled with the non-metallic material 60. The non-metallic material 60 is in contact with the rear surface 202 of the face 20, and is continuously formed to fill each depression 22. Each depression 22, however, does not have to be completely filled with the non-metallic material 60, and may be at least partially filled with the non-metallic material 60.

The non-metallic material 60 is preferably elastic. Examples of the non-metallic material 60 include, but are not limited to, resins such as silane resins, thermoplastic polyurethane, and polypropylene and rubbers such as natural rubber, butyl rubber, chlorosulfonated polyethylene rubber, acrylonitrile butadiene rubber, silicone rubber, and styrene rubber. Of these, silane resins, which enjoy a good vibration absorbing characteristic and good adhesion to metal, are preferable in particular.

Thus, in the iron head 1, by forming the depressions 22 in the periphery of the sweet area 20*se* of the face 20, the face 20 is reduced in thickness locally in the periphery of the sweet area 20*se*. Therefore, the coefficient of restitution of the iron head 1 increases in the periphery of the sweet area 20*se*. As a result, in the face 20, an area of high coefficients of restitution extends to the periphery of the sweet area 20*se*. Therefore, it is possible to reduce the loss of flight distance of a golf ball when the golf ball is struck by an area other than the sweet area 20*se* (off the center). As a result, it is possible to reduce a difference in the flight distance of a golf ball between when the golf ball is struck by the sweet area 20*se* and when the golf gall is struck by an area other than the sweet area 20*se*, so that the flight distance can be stable.

Furthermore, the depressions 22 more distant from the sweet area 20*se* are greater in size and depth, so that the face 20 can be further reduced in thickness in an area more distant from the sweet area 20*se*. Therefore, it is possible to further reduce the loss of flight distance and to further stabilize flight distance.

Furthermore, the individual depressions 22 provided in the rear surface 202 of the face 20 are filled with the non-metallic material 60 to increase the contact area of the rear surface 202 and the non-metallic material 60. Therefore, the bonding strength of the rear surface 202 of the face 20 and the non-metallic material 60 increases. This makes it possible to prevent the rear surface 202 and the non-metallic material 60 from being detached from or displaced relative to each other by the impact of striking a golf ball.

In the case of a hollow structure with a space such as the iron head 1, the detachment or displacement of the non-metallic material 60 cannot be fixed. Therefore, it is of great significance to increase the bonding strength of the rear surface 202 of the face 20 and the non-metallic material 60 to prevent the rear surface 202 and the non-metallic material 60 from being detached from or displaced relative to each other.

Furthermore, an increase in the bonding strength of the rear surface 202 of the face 20 and the non-metallic material 60 increases the vibration damping effect at the time of striking a golf ball, thus making it possible to improve impact feel.

Furthermore, the rear protrusion 14 includes the wall faces 141 through 146 that face the rear surface 202 of the face 20. As a result, when striking a golf ball, a force that the iron head 1 receives in a direction normal to the rear surface 202 of the face 20 reaches the wall faces 141 through 146 through the non-metallic material 60. Therefore, impact feel can be improved.

In particular, the depth D is 5 mm or more and 15 mm or less, and preferably, 10 mm or more and 15 mm or less, at the wall face 146 provided at the deepest portion of the rear protrusion 14. As a result, it is possible to ensure that the non-metallic material 60 positioned between the rear surface 202 of the face 20 and the wall face 146 has a certain thickness or more. Therefore, it is possible to further increase the impact feel improvement effect and to deepen and lower the center of gravity of the iron head 1.

[Variation]

A variation of the embodiment is directed to an iron head having a different face shape. In the description of the variation, a description of the same elements or components as those of the above-described embodiment may be omitted.

Figure 6:
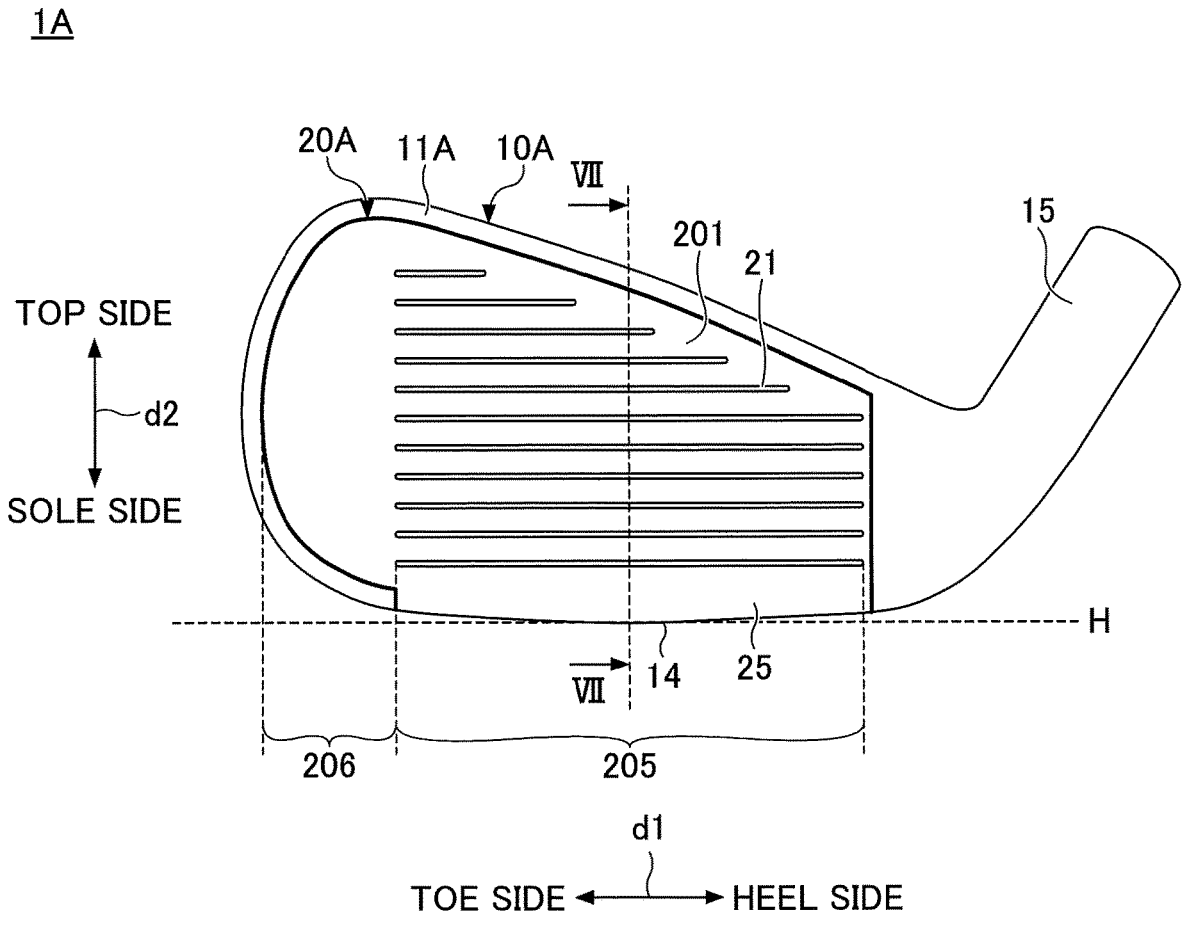
FIG. 6 is a front elevational view of an iron-type golf club head according to a variation of the embodiment.
Figure 7:
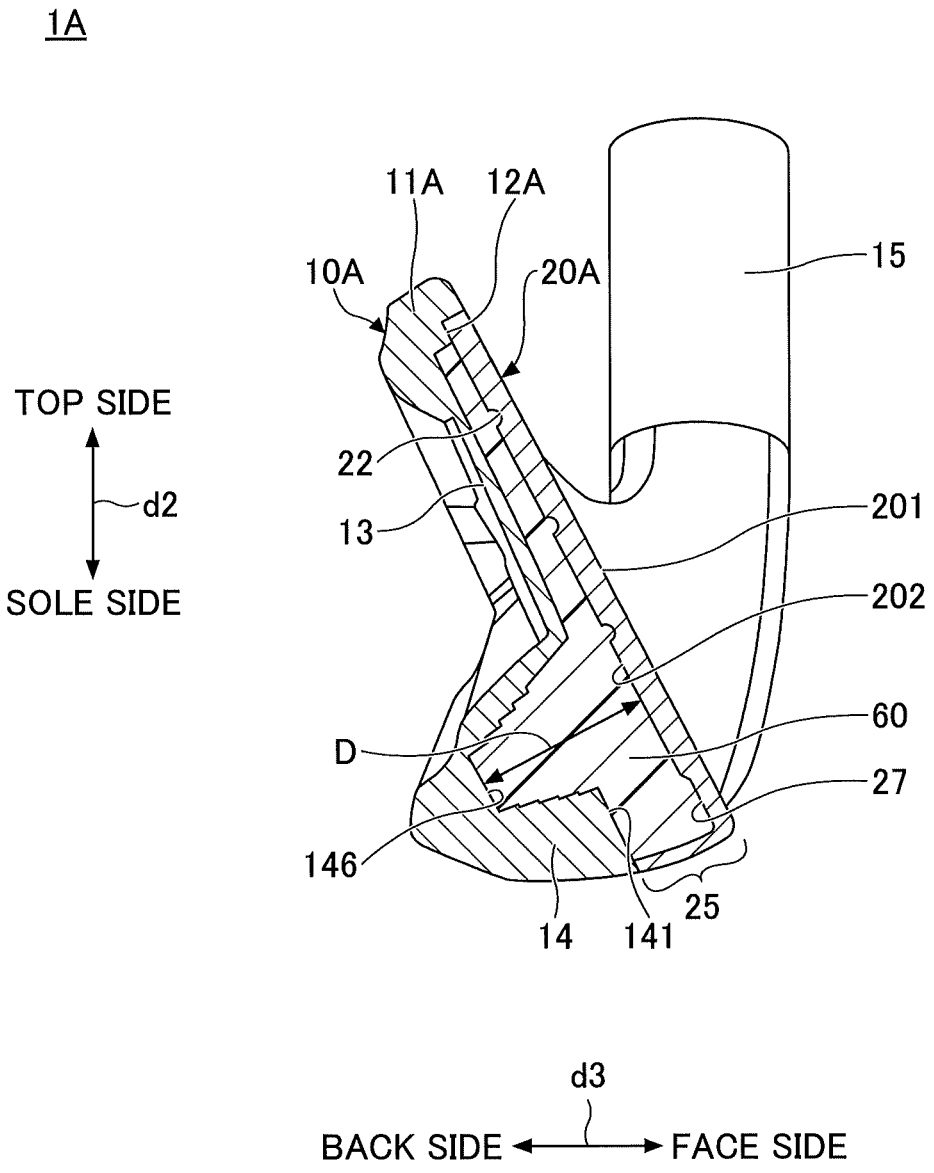
FIG. 7 is a sectional view of the iron-type golf club head according to the variation.

FIG. 6 is a front elevational view of an iron head 1A according to the variation. FIG. 7 is a sectional view of the iron head 1A, illustrating a section taken along a plane indicated by the line VII-VII of FIG. 6, which extends in the face-back direction and passes through the substantial center of a face 20A of the iron head 1A.

The iron head 1A depicted in FIGS. 6 and 7 is a head for an iron-type golf club, and is a structure including a body 10A and the face 20A. The face 20A is joined to the body 10A by, for example, welding.

Figure 8:
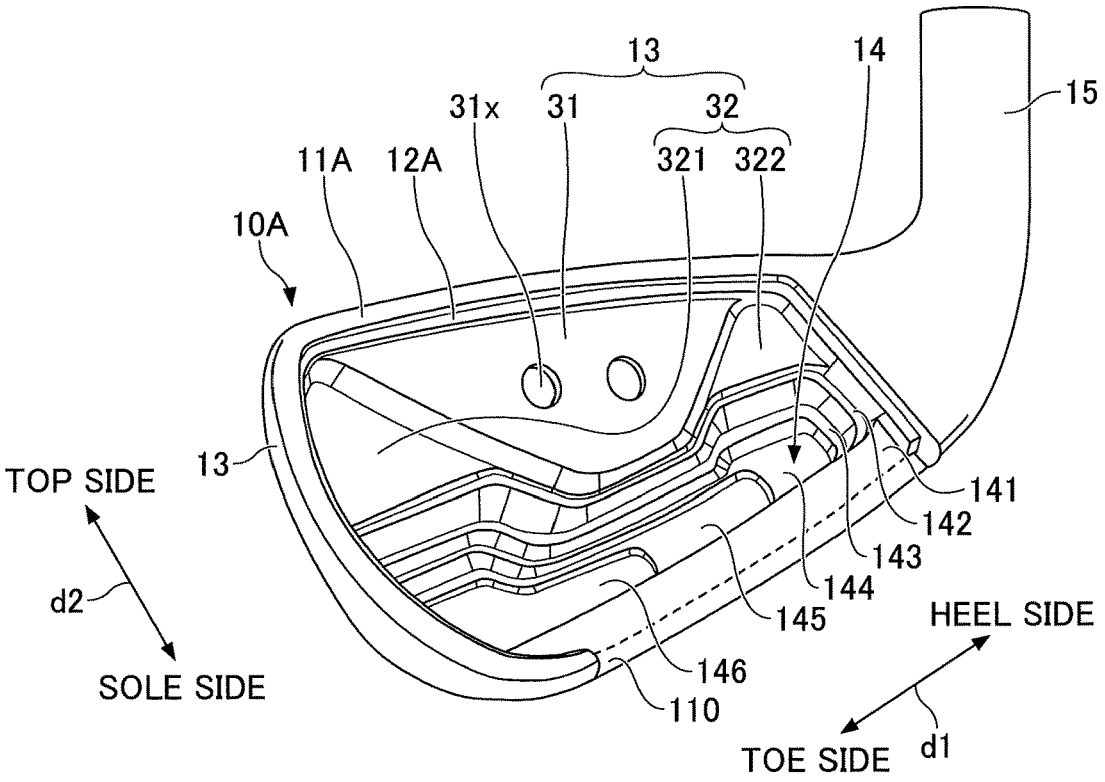
FIG. 8 is a front-side perspective view of a body according to the variation.
Figure 9:
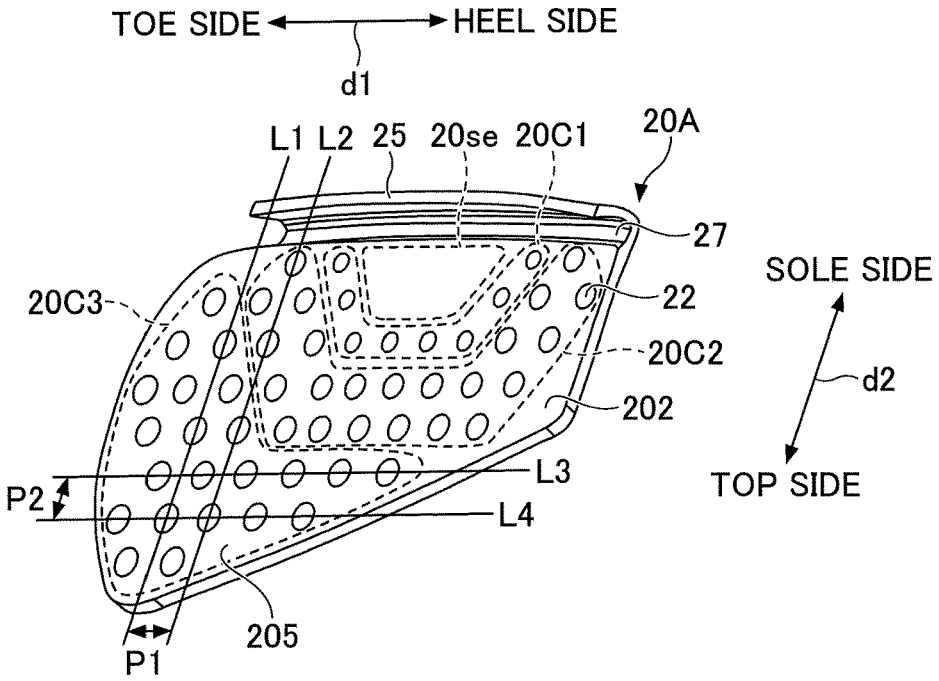
FIG. 9 is a rear-side perspective view of a face according to the variation.

FIG. 8 is a front-side perspective view of the body 10A according to the variation. FIG. 9 is a rear-side perspective view of the face 20A according to the variation.

Referring to FIGS. 8 and 9 as well as FIGS. 6 and 7, the body 10A includes a frame 11A, a face placement part 12A, the back 13, the rear protrusion 14, and the hosel 15.

In the body 10A, the frame 11A and the face placement part 12A include a cut 110 on the sole side. That is, while the frame 11 and the face placement part 12 of the body 10 of the iron head 1 have a surrounding frame shape (see, for example, FIG. 4), the frame 11A and the face placement part 12A of the body 10A of the iron head 1A do not have a surrounding frame shape and are made discontinuous (open) by the cut 110 on the sole side.

The face 20A has a substantially L-shaped sectional shape. Specifically, the face 20A includes a rearward extension 25 extending rearward (to the back side) from the lower end of the striking part 205 on the sole side. The rearward extension 25 fits into the body 10A on the sole side to form part of the sole together with part of the rear protrusion 14. In other respects, the face 20A is equal to the face 20 (see, for example, FIG. 5).

Thus, the face 20A has a substantially L-shaped sectional shape, so that the coefficient of restitution of the face 20A can be increased.

The face 20A includes a thin part 27 where the thickness of the face 20A is reduced. The thin part 27 is elongated in the toe-heel direction near the boundary between the striking part 205 and the rearward extension 25 on the sole side. The thin part 27 is depressed toward the face surface 201 relative to the rear surface of the striking part 205. The size of depression of the thin part 27 relative to the rear surface of the striking part 205 is, for example, 0.1 mm or more and 1.5 mm or less, and preferably, 0.2 mm or more and 0.6 mm or less. The length of the thin part 27 in the toe-heel direction is, for example, 5 mm or more and 80 mm or less, and preferably, 50 mm or more and 80 mm or less.

The rearward extension 25 of the face 20A is fitted into the cut 110 of the body 10A. That is, the face 20A is positioned by the face placement part 12A on the top side, and the rearward extension 25 is fitted into the cut 110 to connect to the rear protrusion 14 of the body 10A on the sole side.

The wall face 141 of the body 10A faces and is parallel to the thin part 27. The space between the thin part 27 and the wall face 141 is filled with the non-metallic material 60. The thin part 27, however, does not have to be completely filled with the non-metallic material 60, and may be at least partially filled with the non-metallic material 60.

Thus, by providing the thin part 27 in a lower portion of the face 20A, the flexure of the striking part 205 when striking a golf ball can be increased.

Furthermore, the thin part 27 of the face 20A is filled with the non-metallic material 60 to further increase the contact area of the rear surface 202 of the face 20A and the non-metallic material 60. Therefore, the bonding strength of the rear surface 202 and the non-metallic material 60 further increases. This makes it possible to further prevent the rear surface 202 and the non-metallic material 60 from being detached from or displaced relative to each other by the impact of striking a golf ball. Furthermore, a further increase in the bonding strength of the rear surface 202 and the non-metallic material 60 further increases the vibration damping effect at the time of striking a golf ball, thus making it possible to further improve impact feel.

Furthermore, because the thin part 27 is also positioned below the sweet area 20*se*, the coefficient of restitution of the face 20A can be increased.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the invention have been described in detail, it should be understood that the various changes, substitutions, and alterations could be made hereto without departing from the spirit and scope of the invention.

What is claimed is:

1. An iron-type golf club head comprising:

a body; and a face joined to the body, the face including a front surface and a rear surface, the front surface including a ball striking surface, the rear surface facing an interior surface of the body, wherein a plurality of independent depressions are formed in the rear surface toward the front surface, each of the independent depressions is at least partially filled with a non-metallic material, a space between the interior surface of the body and the rear surface of the face is filled with the non-metallic material, the body includes a back and a rear protrusion, the rear protrusion being on a sole side of the back below a center of the iron-type golf club head, and an interior surface of the rear protrusion includes a stepped portion that faces the rear surface of the face.

2. The iron-type golf club head as claimed in claim 1, wherein the stepped portion forms a plurality of wall faces that face the rear surface of the face.

3. The iron-type golf club head as claimed in claim 1, wherein a depth of a deepest part of the stepped portion from the rear surface of the face is 5 mm or more and 15 mm or less.

4. The iron-type golf club head as claimed in claim 1, wherein the back includes a flat part in which two or more openings are provided.

5. The iron-type golf club head as claimed in claim 1, wherein the non-metallic material contacts the rear surface and is continuously formed to fill each of the independent depressions.

6. The iron-type golf club head as claimed in claim 1, wherein the face includes a striking part and a toe part, the toe part being on a toe side of the striking part, and the space is formed between the interior surface of the body and a rear surface of the striking part and between the interior surface of the body and a rear surface of the toe part.

7. An iron-type golf club head comprising:

a body; and a face joined to the body, the face including a front surface and a rear surface, the front surface including a ball striking surface, the rear surface facing an interior surface of the body, wherein a plurality of independent depressions are formed in the rear surface toward the front surface, each of the independent depressions is at least partially filled with a non-metallic material, and the face includes a rearward extension extending rearward of the iron-type golf club head, the rearward extension being fitted into the body on a sole side to form a part of a sole of the iron-type golf club head.

8. The iron-type golf club head as claimed in claim 7, wherein the face includes a thin part on the sole side, the thin part being at least partially filled with the non-metallic material.

9. The iron-type golf club head as claimed in claim 8, wherein the body includes a wall face that faces the thin part.

10. The iron-type golf club head as claimed in claim 7, wherein the body includes a face placement part and a cut provided in the face placement part on the sole side, the face is positioned by the face placement part on a top side, and the rearward extension is fitted into the cut to connect to the body on the sole side.

11. The iron-type golf club head as claimed in claim 7, wherein the non-metallic material contacts the rear surface and is continuously formed to fill each of the independent depressions.

12. The iron-type golf club head as claimed in claim 7, wherein a space between the interior surface of the body and the rear surface of the face is filled with the non-metallic material.

13. The iron-type golf club head as claimed in claim 12, wherein the face includes a striking part and a toe part, the toe part being on a toe side of the striking part, and the space is formed between the interior surface of the body and a rear surface of the striking part and between the interior surface of the body and a rear surface of the toe part.

* * * * *